United States Patent [19]

Stotz et al.

[11] 4,154,649

[45] May 15, 1979

[54] PULP FEED FOR A PAPER MAKING MACHINE

[75] Inventors: Wolf-Gunter Stotz, Ravensburg; Otto Hildebrand, Taldorf; Siegfried Reutter, Gerbertshaus, all of Fed. Rep. of Germany

[73] Assignee: Escher Wyss GmbH, Ravensburg, Fed. Rep. of Germany

[21] Appl. No.: 925,206

[22] Filed: Jul. 17, 1978

[30] Foreign Application Priority Data

Jul. 27, 1977 [CH] Switzerland ..... 9277/77

[51] Int. Cl.[2] ..... D21F 1/04

[52] U.S. Cl. ..... 162/317; 162/347

[58] Field of Search ..... 162/317, 347

[56] References Cited

U.S. PATENT DOCUMENTS 3,909,349 9/1975 Stotz et al. ..... 162/317

*Primary Examiner*—Richard V. Fisher

*Attorney, Agent, or Firm*—Werner W. Kleeman

[57] ABSTRACT

A pulp feed for a paper making machine comprising a nozzle channel or duct for the flow of the pulp or the like and terminating at a movable permeable element. The pulp feed has a first section bounded by a lower lip closer to the permeable element and a more remotely located pivotable upper lip which is adjustable at its edge which is downstream with regard to the flow of the pulp. The pulp feed further includes a second section which is bounded, on the one hand, by the permeable element, and on the other hand, by a pre-lip which merges with the upper lip and is pivotably mounted thereat by means of at least one substantially plug-shaped part. The outlet end of the pre-lip is adjustable in relation to the permeable element. The plug-shaped part is only rotatably mounted at least at two locations which are removed from one another and at the remaining bearing locations the bearing means possesses a displaceability with play in a plane containing an appreciable component in the direction of the surfaces of the upper lip and the pre-lip, respectively, bounding the nozzle channel or duct.

9 Claims, 4 Drawing Figures

PULP FEED FOR A PAPER MAKING MACHINE

BACKGROUND OF THE INVENTION

The present invention relates to a new and improved construction of a pulp feed for a paper making machine.

Generally speaking, the pulp feed for a paper making machine of the present development is of the type comprising a nozzle channel or duct for the flow of the pulp. This nozzle duct terminates at a movable permeable element. The pulp feed has a first section which is bounded by a lower lip closer to the element and a more remotely located pivotable upper lip which is adjustable at its edge which is downstream with respect to the direction of flow of the pulp or like fluent material. There is also provided a second section which, on the hand, is bounded by the permeable element and, on the other hand, by a pre-lip which merges with the upper lip and is pivotably mounted thereat by means of at least one plug-like part. The outlet end of the pre-lip is adjustable in relation to the element.

A pulp feed for a paper making machine of this general type is disclosed, for instance, in the commonly assigned U.S. Pat. No. 3,909,349, granted Sept. 30, 1975 to Wolf-Gunter Stotz and Otto Hildebrand. With this state-of-the-art pulp feed there is formed between the edges of the lower lip and the upper lip a throat whose cross-section determines the quantity of material, i.e. pulp, flowing per unit of time at the related location, and thus, the weight profile section, of the formed web. Therefore, there is an interest in the possibility of being able to adjust the width of the gap between the ends of the lower lip and the upper lip at as many locations as possible independently of one another over the width of the pulp feed. yet, heretofore such type adjustment was not possible, since the pre-lip was pivotably connected with the upper lip and free of play. The pre-lip, owing to its rigidity, rendered impossible independent movements of different locations of the upper lip.

SUMMARY OF THE INVENTION

Hence, with the foregoing in mind it is a primary object of the present invention to provide an improved construction of pulp feed which is not associated with the aforementioned drawbacks and limitations of the prior art proposals.

Another and more specific object of the present invention aims at the provision of a new and improved construction of pulp feed of the previously mentioned type, wherein there is possible a free adjustability at different locations of both the upper lip and the pre-lip independently of one another.

Now in order to implement these and still further objects of the invention, which will become more readily apparent as the description proceeds, the invention contemplates that the plug-shaped part is only rotatably mounted at least at two locations removed or spaced from one another, and that at the remaining bearing or support locations the bearing means has a displaceability with play in a plane containing an appreciable component in the direction of the surfaces of the upper lip and the pre-lip, respectively, delimiting or bounding the nozzle duct.

By virtue of the inventive measures during the adjustment movements there is rendered possible a twisting or torsion of the plate-shaped pre-lip as well as the upper lip. Consequently, there are formed deformations in the manner of a screw or helical surface which are rendered possible due to a mutual displaceability with play at the bearing locations. In this manner it is possible to independently deform both of the adjustable lips, the upper lip and the pre-lip, and thus, to freely adjust the corresponding cross-section.

The plug-shaped part can preferably possess a substantially cylindrical bead which is constructed of one-piece with the pre-lip and extends over the entire length of the pre-lip, i.e., the width of the paper making machine. As a result, there is obtained a simple compact construction which enables robustly structuring the bearing locations.

The bearing locations having play can possess parallel planar or flat guide surfaces, the spacing of which essentially is equal to the diameter of the plug-shaped part which, however, enable a movement of the plug-shaped part with an appreciable component in the direction of the relevant surface of the upper lip and the pre-lip.

The movable permeable element can be arranged at a cylinder at the region of the pulp channel or duct. The cylinder can be part of a suction former device, and a longitudinal screen or sieve is guided over the cylinder. However, the cylinder also can be part of a round screen drum or circular sieve machine. In such case there is only provided one cylindrical screen or sieve from which there is removed the formed paper web.

Due to the inventive measures there is particularly overcome a known drawback of suction former devices and round screen machines or sieve drums, namely, that the weight-transverse sectional shape or profile of the formed web only could be influenced with extreme difficulty since there was not available any possibility of individual adjustment of the throat width at different locations in the transverse direction of the machine.

It should be however understood that the permeable element also can be flat or planar at the region of the pulp feed channel or nozzle duct.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
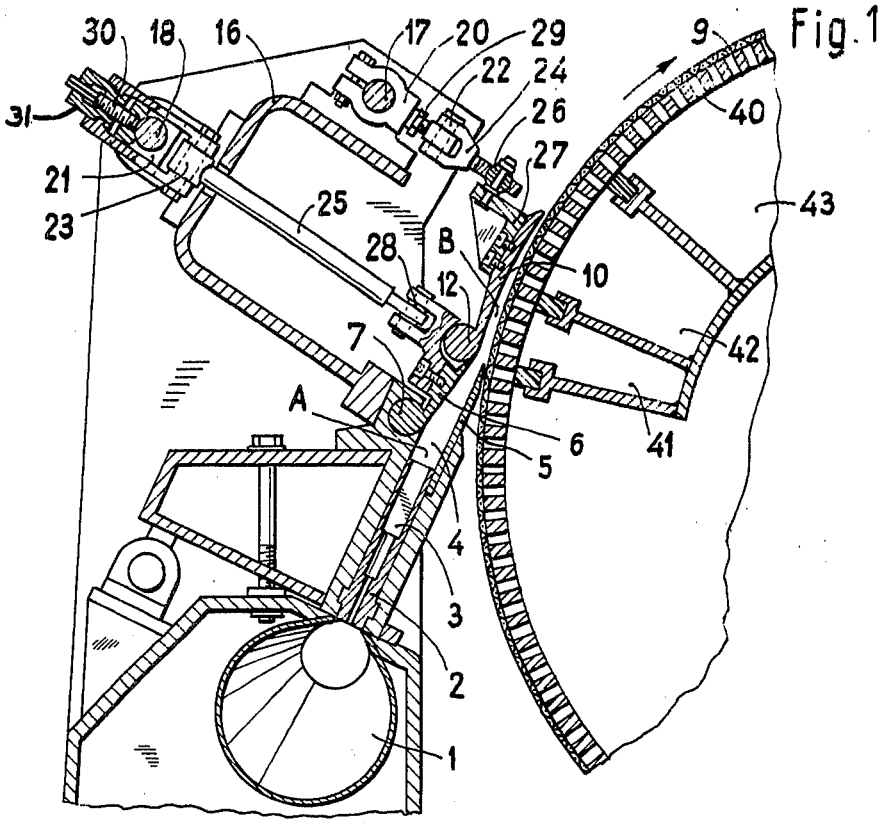
FIG. 1 is a cross-sectional view of a pulp feed constructed according to the teachings of the present invention.

Describing now the drawings, it is to be understood that the exemplary embodiment of pulp feed for a paper making machine as shown in FIGS. 1 to 4 will be seen to comprise a distributor pipe or manifold 1 which in conventional manner may be of essentially conical construction. Merging with this distributor pipe 1 is a distributor device 2 having a diffusor channel or duct 3 with a not particularly referenced step-like widened portion. Merging with the distributor device 2 is a nozzle channel or duct 4. This nozzle duct 4 contains a first section A which is bounded by a fixed lower lip 5 and an adjustable upper lip 6.

Figure 2:
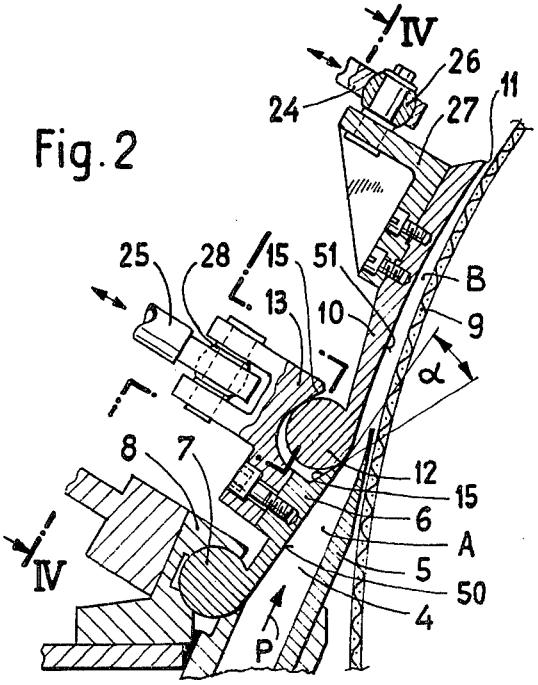
FIG. 2 is a sectional view of the arrangement of FIG. 1 on an enlarged scale and illustrating a rotatable and displaceable bearing location and taken substantially along the line II—II of FIG. 4.
Figure 3:
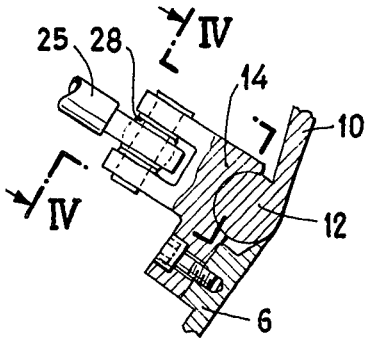
FIG. 3 is a sectional view of the arrangement shown in FIG. 2 illustrating only one rotatable bearing location and taken substantially along the line III—III of FIG. 4.

As particularly well seen by referring to FIG. 2, the upper lip 6 is provided with a substantially cylindrical bead or protuberance 7 which is pivotably mounted free of play in bearings or bearing means 8. At the end of the upper lip 6 which is downstream with regard to the flow of the pulp, i.e. a suspension of fibers and additional materials in water or other fluent material, as indicated by the arrow P, there is connected a pre-lip 10. This pre-lip 10 together with a permeable element 9, in this case a sieve or screen, bounds a second section B of the nozzle duct or channel 4. The pre-lip 10, which is essentially of plate-shaped construction, has an outlet edge 11. At its trailing or upstream edge the pre-lip 10 is provided with a substantially cylindrical bead or protuberance 12 which is formed of one-piece together with a plate-shaped part of the pre-lip 10. This bead 12 defines a plug-shaped part which extends along the entire length of the pre-lip 10, i.e. over the entire width of the machine, and is fixedly retained at a number of locations in bearings 13 (FIG. 2) and 14 (FIG. 3). The bearings or bearing means 14, similar to the bearings 8, are rotatable and structured to have such slight play that they only enable a mutual pivotal movement of the mutually interconnected parts 6 and 10.

On the other hand, the bearings or bearing means 13 contain essentially parallel planar or flat guide surfaces 15 whose spacing from one another essentially is the same size as the diameter of the cylindrical bead or protuberance 12. As best seen by referring to FIG. 2, the guide surfaces 15 enable a movement of the plug-shaped part or bead 12 in the direction of the guide surfaces 15. These guide surfaces 15 thus enable a movement of the bead 12 of the pre-lip 10 towards the upper lip 6 or away therefrom with corresponding twisting of the pre-lip 10 about the edge 11 and the upper lip about the bead 7.

As also seen by referring to FIG. 1, the upper lip 6 and pre-lip 10 are attached to a transverse support or carrier 16 which extends over the entire width of the machine. At the transverse support 16 there are movably guided in the transverse direction of the machine, i.e., in a direction perpendicular to the plane of the showing of FIG. 1, adjustment rods 17 and 18 and suitable bearings. At the rods 17 and 18 there are attached connection elements 20 and 21 which are equipped with the plugs 22 and 23 or equivalent structure. Engaging with the plugs 22 and 23 are pivotable connection rods 24 and 25, respectively. The connection rods 24 are connected by spherical bearings 26 with parts or elements 27 which are attached at the downstream edge of the pre-lip 10. The connection rods 25 engage at the bearings 13 and 14, and specifically likewise by means of spherical or ball bearings 28 or equivalent structure. As to the mode of operation of such type adjustment devices, which are not particularly part of the subject matter of the present development, attention is directed to the previously mentioned U.S. Pat. No. 3,909,349, granted Sept. 30, 1975, the disclosure of which is incorporated herein by reference. The effective length of the connection rods 24 and 25 is adjustable by means of the threaded parts or elements 29 and 30, respectively. The threaded element 30 serves for the displacement movement of a link 31 or equivalent structure in the plane of the drawing along a not particularly illustrated guide at the element 21.

Figure 4:
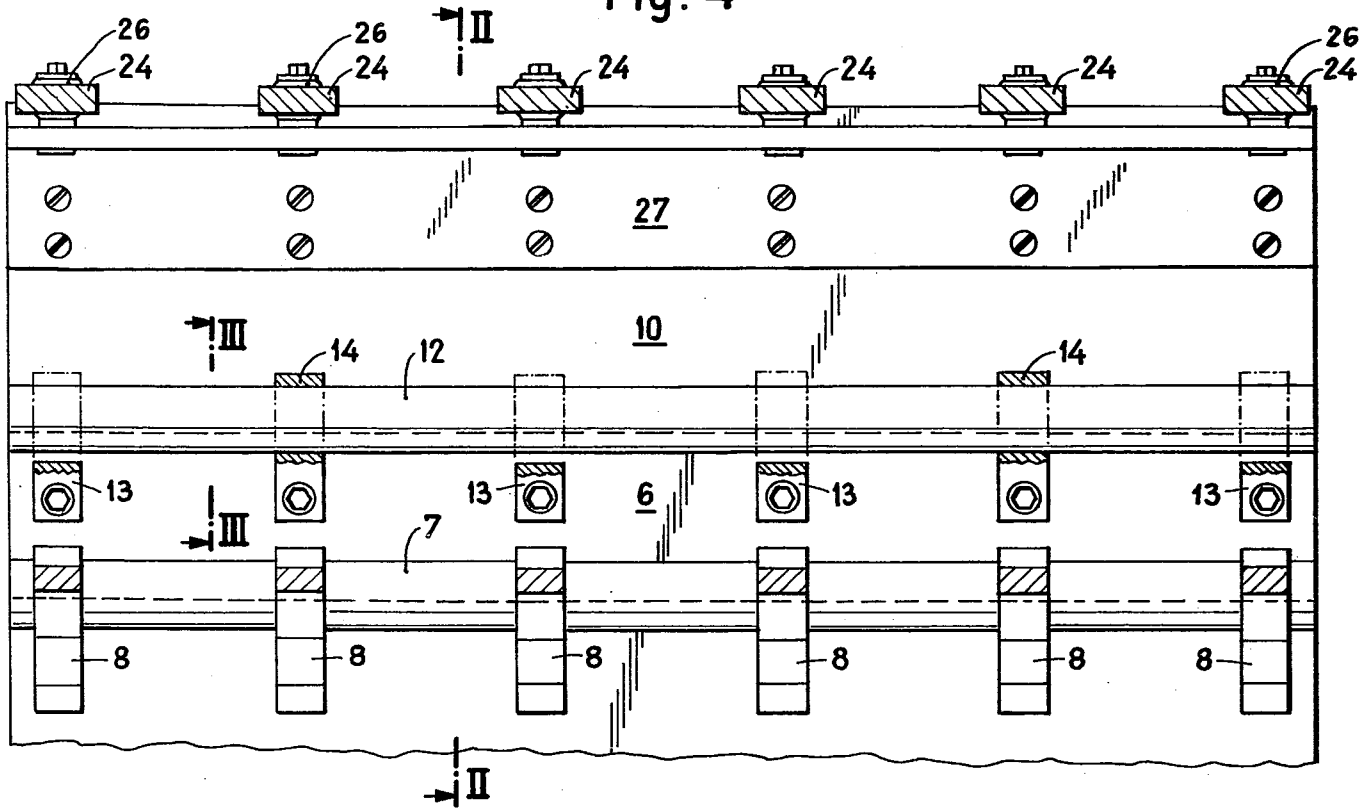
FIG. 4 is a partial sectional view of the equipment, taken substantially along the section line IV—IV of FIGS. 2 and 3.

FIG. 4 is a sectional view taken essentially along the line IV—IV of the showing of FIG. 2 and shows the arrangement of the bearing locations or bearings 14 free of play and the bearing locations or bearings 13 having play.

FIG. 4 is a simplified illustration, since of course there is provided over the width of the machine a considerably greater number of bearings than six bearings.

As best seen by referring to FIG. 4, there are provided two bearings 14 which are only rotatable and which are spaced from one another and located at the region of the outer edges of the lips 6 and 10. All of the remaining bearing locations or bearings are displaceable bearings 13 of the type shown in FIG. 2.

During operation the lip 10 is fixedly retained, owing to the rotatable bearings 14, at the lip 6 in the direction of flow of the pulp, i.e. at the channel section B. At the remaining bearing locations or bearings both of these lips are simply mutually guided, so that the aforementioned twisting or torsion is capable of occurring so that there can be accomplished a separate adjustment or setting at the individual locations.

The inventive apparatus can be preferably employed at cylinder machines of the type according to the showing of FIG. 1, for instance at round screen or sieve machines or at suction formers where there is guided a longitudinal or long screen over a suction cylinder.

According to the showing of FIG. 1 the permeable element 9 in the form of a screen is guided over a perforated cylinder 40 and is provided with the suction boxes 41, 42 and 43. However, it should be understood that the screen or sieve 9 can be linearly guided at the location of the pulp feed apparatus and therefore can be flat. Therefore, permeable element 9 can be also conceptually considered as a flat screen.

As also best seen by referring to FIG. 2, both of the parallel surfaces 15 extend at an acute angle $\alpha$ with regard to the surface 50 of the upper lip 6 which at this side bounds the section A of the pulp nozzle duct or channel 4. A like-wise acute, somewhat greater, not particularly referenced angle exists with respect to the corresponding surface 51 of the pre-lip 10.

The optimum angle would be angle $\alpha=0°$ something which however can not be realized in practice. In any event the angle $\alpha$ and the not particularly illustrated other angle must be selected such that the guide surfaces 15 enable movements having an appreciable component in the direction of the surfaces 50 and 51, respectively. As a general rule, the angle $\alpha$ is smaller than 45°.

While there are shown and described present preferred embodiments of the invention, it is to be distinctly understood that the invention is not limited thereto, but may be otherwise variously embodied and practiced within the scope of the following claims.

What we claim is:

1. A pulp feed for a paper making machine, comprising:

a nozzle duct for the flow of pulp;

a movable permeable element;

said nozzle duct terminating at said movable permeable element;

a first section bounded by a lower lip situated closer to said movable permeable element;

a more remotely located pivotable upper lip having an adjustable edge and located downstream with respect to the direction of flow of the pulp;

a pre-lip which merges with the upper lip;

means for pivotably mounting the pre-lip at said upper lip and incorporating at least one substantially plug-shaped part;

said pre-lip having an outlet end adjustable in relation to said movable permeable element;

a second section bounded by said movable permeable element and said pre-lip;

means for only rotatable mounting said plug-shaped part at least at two locations which are spaced from one another;

each said pre-lip and said upper lip having a respective surface bounding said nozzle duct;

bearing means for supporting said plug-shaped part at other locations than said two locations;

said bearing means possessing a displaceability with play in a plane containing an appreciable component in the direction of the surfaces of the upper lip and the pre-lip bounding said nozzle duct.

2. The apparatus as defined in claim 1, wherein:

said plug-shaped part comprises a substantially cylindrical bead formed of one-piece with said pre-lip and extending essentially over the entire length of said pre-lip.

3. The apparatus as defined in claim 2, wherein:

said bead extends over the width of the paper making machine.

4. The apparatus as defined in claim 1, wherein:

said bearing means comprise substantially parallel displaceable planar guide surfaces;

the mutual spacing of said substantially planar guide surfaces being essentially equal in size to the diameter of the plug-shaped part;

said guide surfaces enabling a movement of the plug-shaped part with an appreciable component in the direction of the related surface of the upper lip and the pre-lip.

5. The apparatus as defined in claim 1, further including:

cylinder means at which there is arranged said movable permeable element at the region of the nozzle duct.

6. The apparatus as defined in claim 5, wherein:

said cylinder means constitutes part of suction former means; and a longitudinal screen guided over said cylinder means.

7. The apparatus as defined in claim 5, wherein:

said cylinder means constitutes part of a round screen machine.

8. The apparatus as defined in claim 1, wherein:

said permeable element is essentially planar at the region of the nozzle duct.

9. A pulp feed for a paper making machine, comprising:

a nozzle duct for the flow of pulp;

a movable permeable element;

means for movably mounting said permeable element;

said nozzle duct being located adjacent said movable permeable element;

a first section bounded by a lower lip situated adjacent said movable permeable element;

a pivotable upper lip having an adjustable edge and located opposite said lower lip and downstream with respect to the direction of flow of the pulp;

a pre-lip which merges with the upper lip;

means for pivotably mounting the pre-lip at said upper lip and incorporating at least one substantially plug-shaped part;

a second section bounded by said movable permeable element and said pre-lip;

means for only rotatably mounting said plug-shaped part at least at two locations which are remote from one another and at remaining bearing locations there are provided bearing means possessing a displaceability with play in a plane extending in the direction of surfaces of the upper lip and the pre-lip bounding said nozzle duct.

* * * * *